US010821321B2

(12) United States Patent
Yoo

(10) Patent No.: US 10,821,321 B2
(45) Date of Patent: Nov. 3, 2020

(54) TREADMILL

(71) Applicant: DRAX INC., Gyeonggi-do (KR)

(72) Inventor: Seon Kyung Yoo, Seoul (KR)

(73) Assignee: DRAX, INC., Gyeonggi-do (KR)

( * ) Notice: Subject to any disclaimer, the term of this patent is extended or adjusted under 35 U.S.C. 154(b) by 0 days.

(21) Appl. No.: 16/232,938

(22) Filed: Dec. 26, 2018

(65) Prior Publication Data

US 2019/0126093 A1 May 2, 2019

Related U.S. Application Data

(63) Continuation of application No. PCT/KR2017/006458, filed on Jun. 20, 2017.

(30) Foreign Application Priority Data

Jun. 28, 2016 (KR) ..... 20-2016-0003753 U
Mar. 29, 2017 (KR) ..... 10-2017-0039953

(51) Int. Cl.
*A63B 22/02* (2006.01)
*A63B 22/20* (2006.01)
*A63B 21/00* (2006.01)

(52) U.S. Cl.
CPC ..... *A63B 22/0285* (2013.01); *A63B 21/4035* (2015.10); *A63B 22/02* (2013.01); *A63B 2022/206* (2013.01)

(58) Field of Classification Search
CPC . A63B 22/0285; A63B 22/02; A63B 22/0214; A63B 22/0221; A63B 21/4035;
(Continued)

(56) References Cited

U.S. PATENT DOCUMENTS 5,184,988 A * 2/1993 Dunham ..... A63B 22/0023 482/51
8,986,169 B2 * 3/2015 Bayerlein ..... A63B 21/0054 482/54

(Continued)

FOREIGN PATENT DOCUMENTS

EP 2705882 A2 3/2014
JP 2009-183607 A 8/2009

(Continued)

OTHER PUBLICATIONS

International Search Report dated Sep. 20, 2017 in corresponding International Application No. PCT/KR2017/006458.

*Primary Examiner* — Loan B Jimenez
*Assistant Examiner* — Kathleen Vermillera
(74) *Attorney, Agent, or Firm* — Knobbe Martens Olson & Bear LLP

(57) ABSTRACT

Provided is a treadmill including a plurality of slats extending in a first direction and arranged in a second direction perpendicular to the first direction. The frame structure supports both ends of each of the plurality of slats to allow the plurality of slats to be movable in the second direction. The frame structure includes a central frame having a top portion having a curved shape. The frame structure further includes a first side frame and a second side frame respectively arranged on both sides of the central frame. A top portion of each of the first and second side frames has a shape corresponding to the curved shape of the central frame.

19 Claims, 14 Drawing Sheets

(58) Field of Classification Search
CPC ..... A63B 21/0728; A63B 2022/206; A63B 69/0028; Y10S 482/00
USPC ..... 248/511, 518, 519, 523, 527, 540, 541
See application file for complete search history.

(56) References Cited

U.S. PATENT DOCUMENTS

| | | | | |
|---|---|---|---|---|
| 9,005,085 | B2 * | 4/2015 | Astilean | A63B 22/02 482/54 |
| 10,238,912 | B2 * | 3/2019 | Chen | A63B 22/0221 |
| 10,537,766 | B2 * | 1/2020 | Cei | A63B 21/157 |
| 2008/0070756 | A1 * | 3/2008 | Chu | A63B 22/02 482/54 |
| 2010/0282938 | A1 * | 11/2010 | Wu | F16B 9/023 248/231.9 |
| 2011/0162173 | A1 * | 7/2011 | Ciminski | A63B 21/0728 24/303 |
| 2015/0210348 | A1 | 7/2015 | Astilean | |
| 2016/0067537 | A1 | 3/2016 | Bayerlein et al. | |
| 2018/0111018 | A1 * | 4/2018 | Lee | A63B 22/0285 |
| 2018/0140896 | A1 * | 5/2018 | Chen | A63B 22/0285 |
| 2019/0118030 | A1 * | 4/2019 | Yoo | A63B 22/0285 |

FOREIGN PATENT DOCUMENTS

| | | | |
|---|---|---|---|
| JP | 2012-065743 | A | 4/2012 |
| KR | 10-1410325 | B1 | 6/2014 |

* cited by examiner

TREADMILL

CROSS-REFERENCE TO RELATED APPLICATIONS

This application is a continuation application and claims the benefit under 35 U.S.C. §§ 120 and 365 of PCT Application No. PCT/KR2017/006458, filed on Jun. 20, 2017, which is hereby incorporated by reference. PCT/KR2017/006458 also claimed priority from Korean Patent Application Nos. 20-2016-0003753 filed on Jun. 28, 2016 and 10-2017-0039953 filed on Mar. 29, 2017 both of which are hereby incorporated by reference.

BACKGROUND

Technical Field

The present disclosure relates to a treadmill.

Related Technology

Treadmills are exercise machines that give the effect of a walking or running exercise in a small space using a belt rotating along an infinite orbit and are also called running machines. Demands for treadmills are ever increasing because treadmills allow users to walk or run indoors at proper temperatures, regardless of the weather.

Treadmills may be classified into automatic treadmills in which a belt is rotated by a separate driving means and manual treadmills in which a belt is rotated by a user's motion without a separate driving means.

Since manual treadmills do not need a separate driving means, manual treadmills are much cheaper than automatic treadmills and the size and weight of manual treadmills are much less than automatic treadmills. Recently, there has been an increasing demand for such manual treadmills.

SUMMARY

Provided is a treadmill in which a central frame and a side frame respectively have curved shapes corresponding to each other.

Provided is also a treadmill in which a side frame and a side cover covering the side frame respectively have curved shapes corresponding to each other.

According to an aspect of the present disclosure, a treadmill includes a plurality of slats extending in a first direction and arranged in a second direction perpendicular to the first direction and a frame structure supporting both ends of each of the plurality of slats to allow the plurality of slats to be movable in the second direction, wherein the frame structure includes a central frame having a top portion having a curved shape and a first side frame and a second side frame respectively arranged on both sides of the central frame. A top portion of each of the first and second side frames has a shape corresponding to the curved shape of the central frame. Each of the first and second side frames includes a plurality of first vertical supports extending in the second direction and separated from each other in the first direction, each of the plurality of first vertical supports having a top portion having a curved shape corresponding to the curved shape of the central frame; and a side plate arranged on the top portion of the plurality of first vertical supports and curved corresponding to the curved shape of the plurality of first vertical supports.

Each of the first and second side frames may further include a plurality of second vertical supports supporting the plurality of first vertical supports, the plurality of second vertical supports being separated from each other in the second direction.

The side plate may be fixed to the plurality of first vertical supports using welding.

The plurality of first vertical supports may include a plurality of welding position guide portions formed on a side facing the side plate.

The plurality of second vertical supports may have different heights from each other.

A number of the plurality of second vertical supports may be at least 3, and a height of a second vertical support on either side in the second direction may be greater than a height of a second vertical support in a middle in the second direction.

The treadmill may further include a handle supporting column fixed to the frame structure, wherein the first and second side frames may include a fixing unit configured to fix the handle supporting column.

The fixing unit may include a pressurizing portion configured to fix the handle supporting column by pressurizing a circumference of the handle supporting column.

The pressurizing portion may include a plurality of pressing plates having a plane and including a pressing hole through which the handle supporting column passes, the plane crossing a length direction of the handle supporting column; and a connecting bar configured to connect the plurality of pressing plates to each other and having a coupling hole.

The fixing unit may further include a guiding support arranged passing through the pressing hole and corresponding to a shape of the handle supporting column.

The side plate may have a cut portion configured to prevent interference between the handle supporting column and the side plate.

The plurality of first vertical supports may have different lengths from each other in the second direction.

The treadmill may further include a first side cover and a second side cover respectively covering the first side frame and the second side frame.

A top portion of each of the first and second side covers may have a shape corresponding to the curved shape of the side plate.

A maximum distance between the side plate and each of the first and second side covers may not exceed 0.5 cm.

The plurality of slats may be moved by a user's leg motion.

According to an embodiment of the present disclosure, a treadmill includes a side frame having a shape corresponding to a top curved shape of a central frame and a side cover having a top curved shape corresponding to the side frame, so that durability of the side cover may be maintained even if a user steps on the side cover.

DETAILED DESCRIPTION

Figure 1:
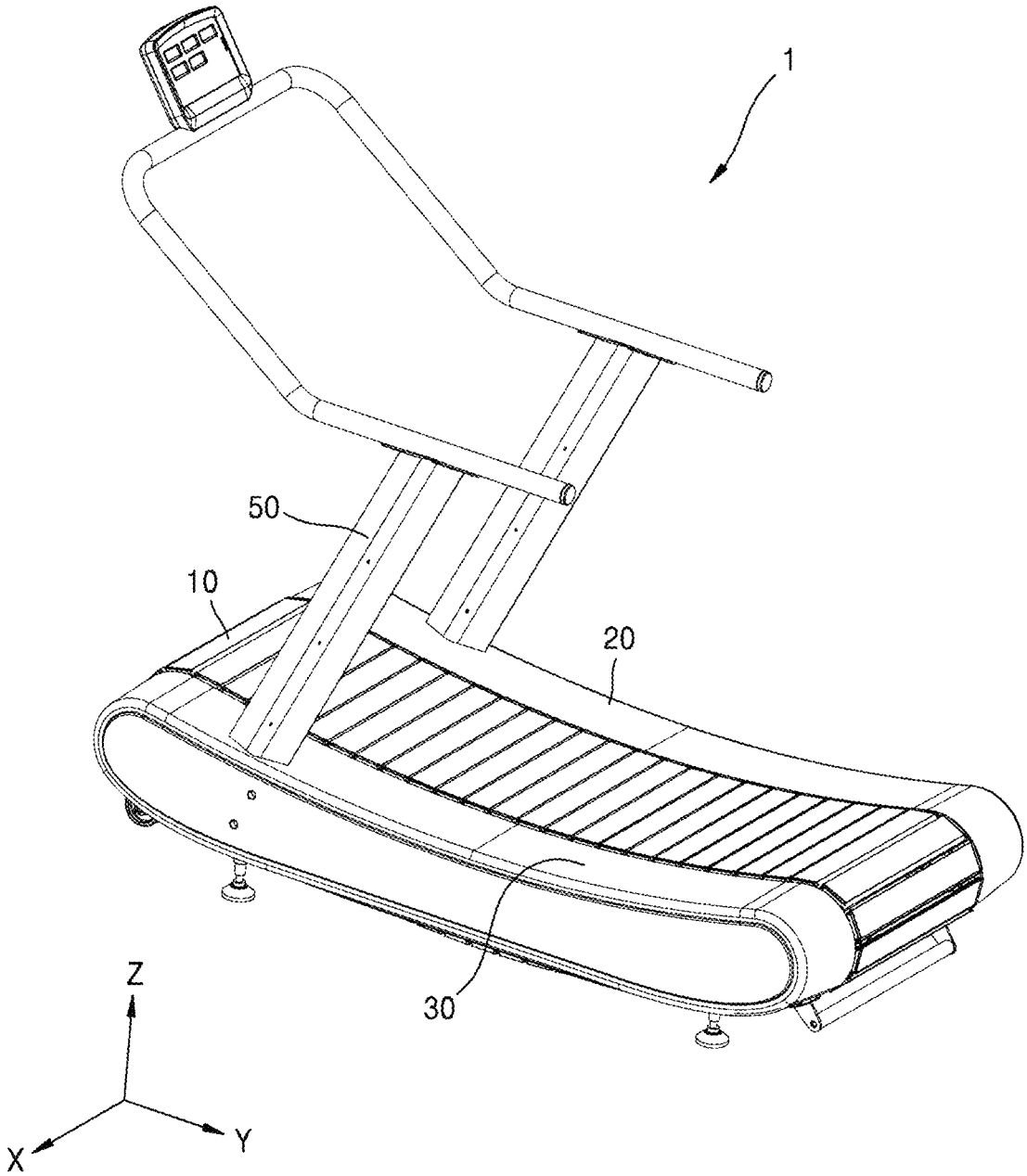
FIG. 1 is a perspective view of a treadmill according to an embodiment of the present disclosure.

Embodiments of the present disclosure will be described in detail hereinafter with reference to the accompanying drawings so as to be easily implemented by one of ordinary skill in the art to which the present disclosure belongs. The present disclosure may, however, be embodied in many different forms and is not limited to the embodiments set forth herein. Portions irrelevant to descriptions will be omitted from the drawings for clarity. In the drawings, like numbers refer to like elements throughout.

When a portion is referred to as being "connected" or "coupled" to another portion herein, it may be "directly connected or coupled" to the other portion or may be "electrically connected" to the other portion with an intervening element therebetween. When a portion "comprises" or "includes" an element, it means that the portion may further comprise or include other elements and does not preclude the presence other elements unless stated otherwise.

FIG. 1 is a perspective view of a treadmill 1 according to an embodiment of the present disclosure.

Referring to FIG. 1, the treadmill 1 includes a plurality of slats 10, a first side cover 20, a second side cover 30, and a handle supporting column 50.

The slats 10 may extend in a first direction and may be arranged in a second direction perpendicular to the first direction. In FIG. 1, the first direction may be an X-axis direction and the second direction may be a Y-axis direction. When a user exercises on the treadmill 1, the slats 10 may be moved in the second direction by the user's leg motion.

The first and second side covers 20 and 30 are respectively provided on both sides of the slats 10 in a length direction thereof, i.e., in the first direction. The first and second side covers 20 and 30 may be provided to respectively cover first and second side frames 141 and 142 (see FIG. 2).

A top portion of each of the first and second side covers 20 and 30 may have a curved shape. The first and second side covers 20 and 30 may include a plastic material.

The handle supporting column 50 supports a handle provided for the safety of a user during an exercise. The handle supporting column 50 may be connected to each of the first and second side frames 141 and 142.

Figure 2:
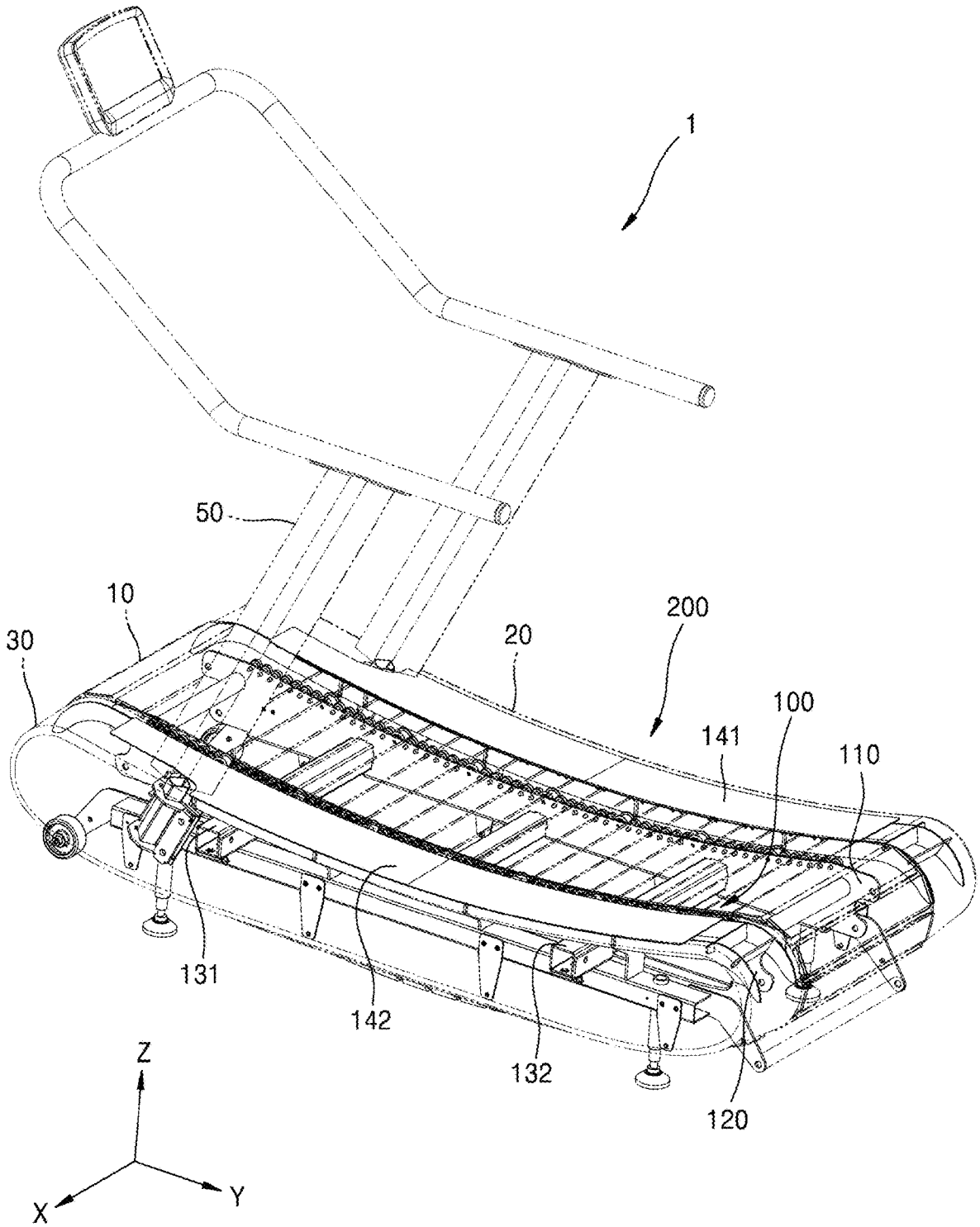
FIG. 2 is a perspective view of a treadmill according to an embodiment of the present disclosure.

FIG. 2 is a perspective view of the treadmill 1 according to an embodiment of the present disclosure.

Referring to FIG. 2, a frame structure 200 is provided inside the slats 10 and the first and second side covers 20 and 30. The frame structure 200 includes a central frame 100 and the first and second side frames 141 and 142.

The frame structure 200 may support both ends of each of the slats 10 such that the slats 10 are movable in the second direction (i.e., the Y-axis direction).

Figure 3A:
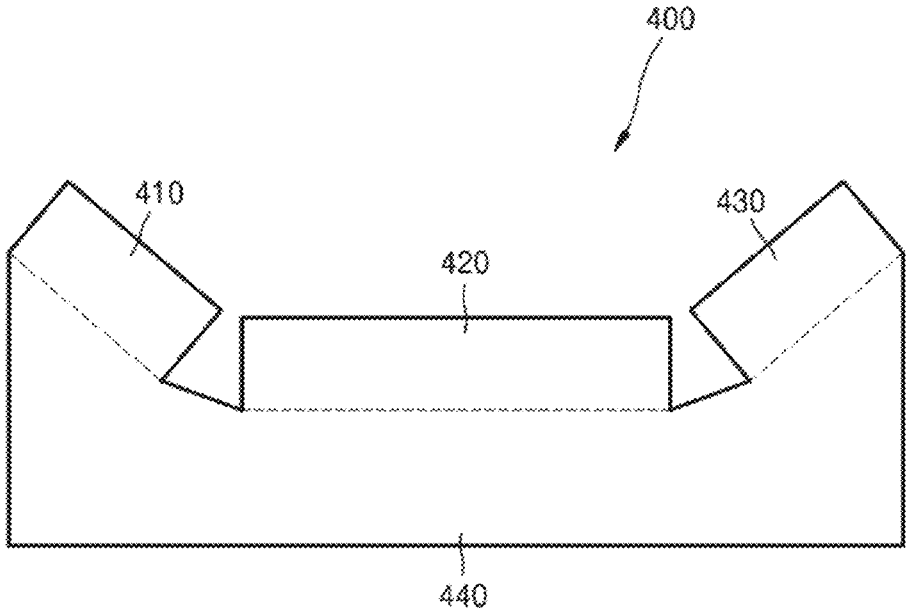
FIG. 3A (Prior Art)
FIG. 3A is a development view of a side frame used in the related art.
Figure 3B:
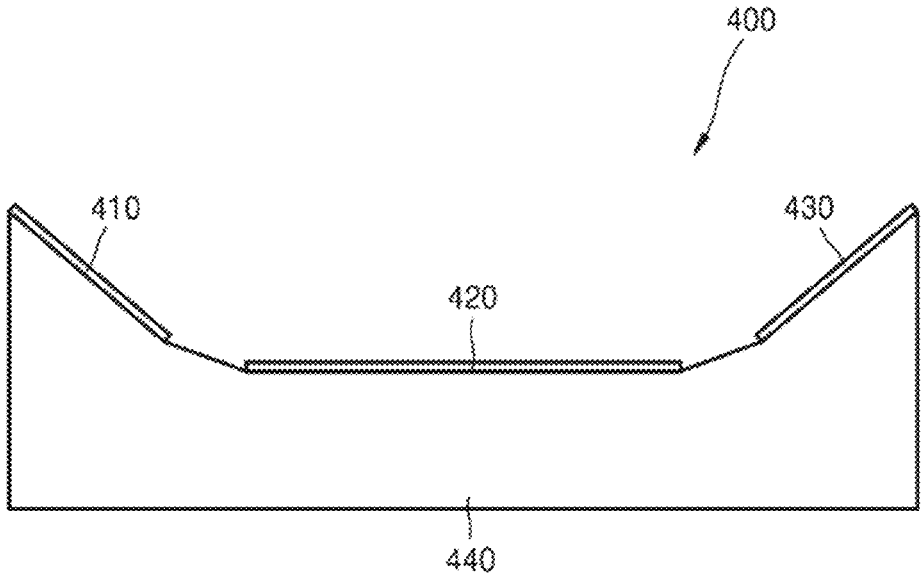
FIG. 3B (Prior Art)
FIG. 3B is a side view of the side frame used in the related art.
Figure 3C:
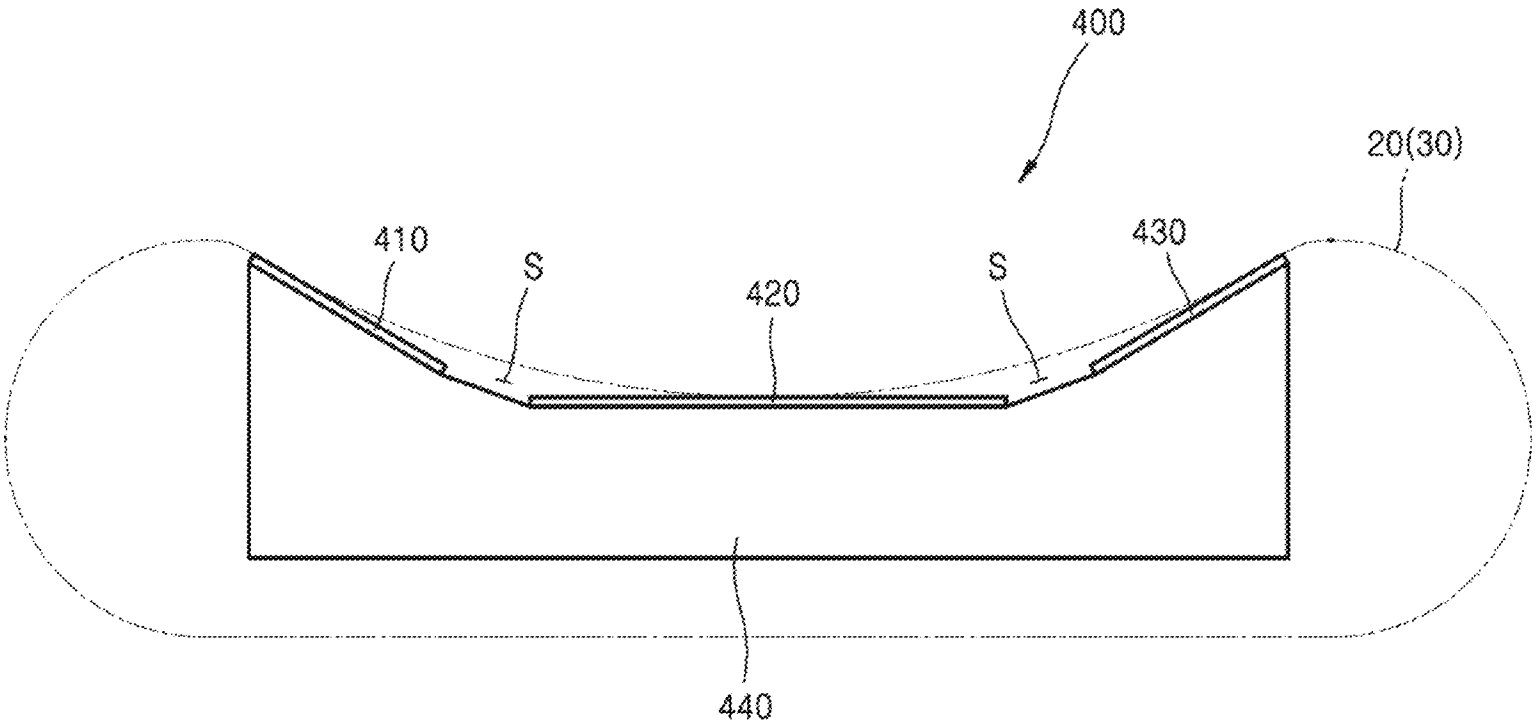
FIG. 3C (Prior Art)
FIG. 3C is a side view for explaining the state of the side frame in use in the related art.

FIG. 3A is a development view of a side frame 400 used in the related art, FIG. 3B is a side view of the side frame 400 used in the related art, and FIG. 3C is a side view for explaining the state of the side frame 400 in use in the related art.

Referring to FIG. 3A, the side frame 400 is provided to allow a user to step on when the user gets on a treadmill. The side frame 400 may include a metal material. According to the related art, the side frame 400 having a plate shape shown in FIG. 3A is prepared first using a metal-working process. The side frame 400 may include a main body 440 and wings 410, 420, and 430. The wings 410, 420, and 430 may be folded at 90° with respect to the main body 440 along broken lines between the main body 440 and the wings 410, 420, and 430.

FIG. 3B illustrates the side frame 400 in which the wings 410, 420, and 430 in FIG. 3A have been folded at 90° with respect to the main body 440. When the side frame 400 is covered with the side cover 20 or 30 having a curved shape, as shown in FIG. 3C, a space S may be present between the side frame 400 and the side cover 20 or 30 due to a shape difference therebetween. Accordingly, when a user steps on the side covers 20 and 30, the side covers 20 and 30 including a plastic material may be broken.

Figure 4:
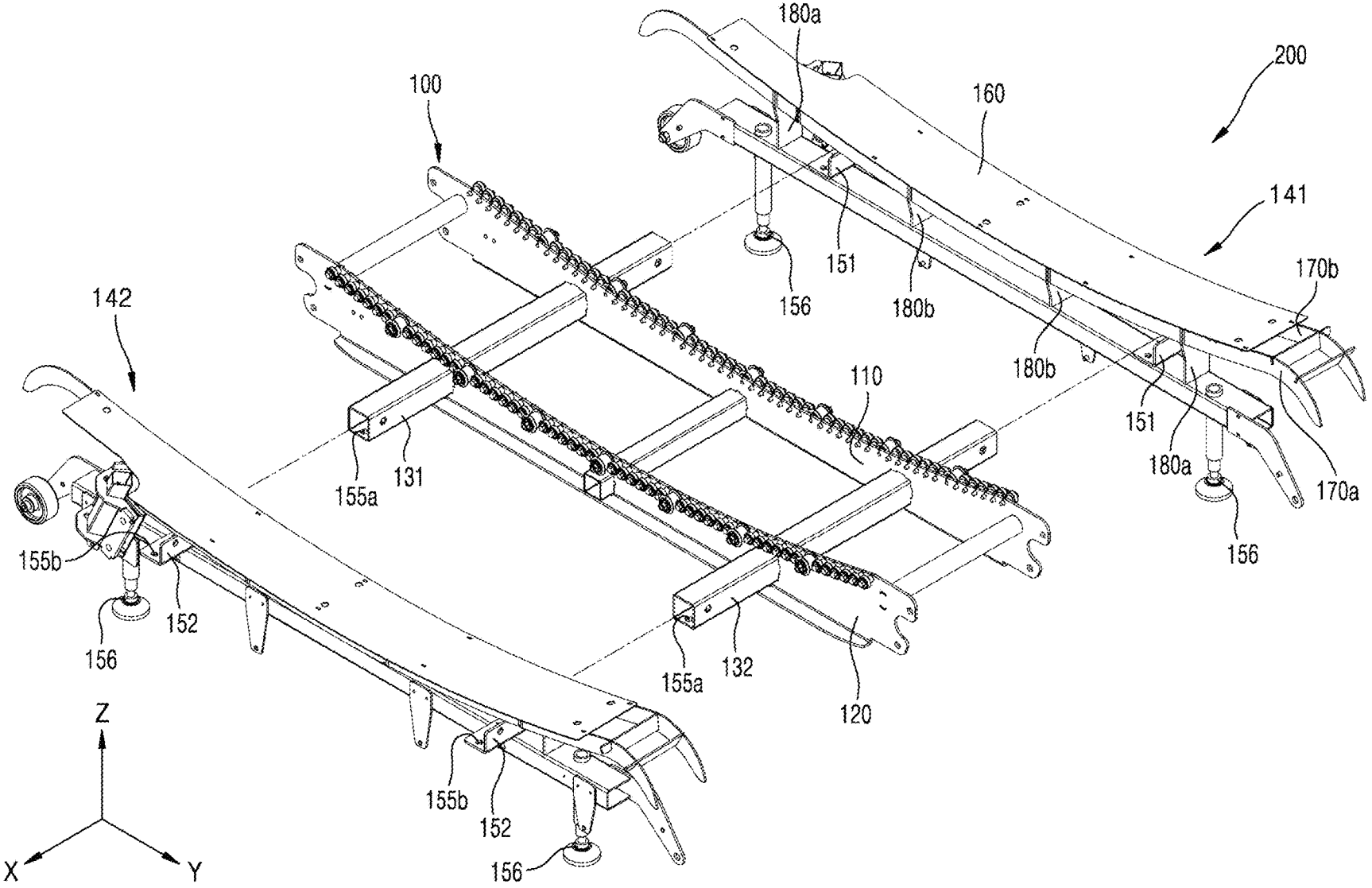
FIG. 4 is an exploded perspective view of a frame structure according to an embodiment of the present disclosure.

FIG. 4 is an exploded perspective view of the frame structure 200 according to an embodiment of the present disclosure.

Referring to FIG. 4, the frame structure 200 includes the central frame 100 and the first and second side frames 141 and 142 respectively connected to the both sides of the central frame 100.

The central frame 100 may include first and second frames 110 and 120, first and second horizontal bars 131 and 132, etc.

The first and second frames 110 and 120 are separated from each other by a certain distance in a first direction. The first and second frames 110 and 120 may be arranged parallel to each other. The first direction is the same as the length direction of the slats 10 and may be the X-axis direction in FIG. 4. The distance between the first and second frames 110 and 120 may be shorter than the length of the slats 10. The first and second frames 110 and 120 may include openings through which the first and second horizontal bars 131 and 132 pass.

A top portion of each of the first and second frames 110 and 120 may have a curved shape. A plurality of holes may be formed in each of the first and second frames 110 and 120 along the curved shape of the top portion. A bearing may be provided in each of the holes.

The first and second horizontal bars 131 and 132 may extend in a direction in which the first and second frames 110 and 120 are separated from each other, i.e., in the first direction, and may penetrate the first and second frames 110 and 120 through the openings. The first and second horizontal bars 131 and 132 may be fixed to the first and second frames 110 and 120 using welding at the openings. The first and second horizontal bars 131 and 132 may extend longer than the distance between the first and second frames 110 and 120.

The first and second side frames 141 and 142 may be respectively arranged on the respective outsides of the first and second frames 110 and 120. Each of the first and second side frames 141 and 142 may include a plurality of first vertical supports 170*a* and 170*b*, a plurality of second vertical supports 180*a* and 180*b*, a lower support 175, a side plate 160, a positioning member 151, and a plurality of legs 156.

Figure 5A:
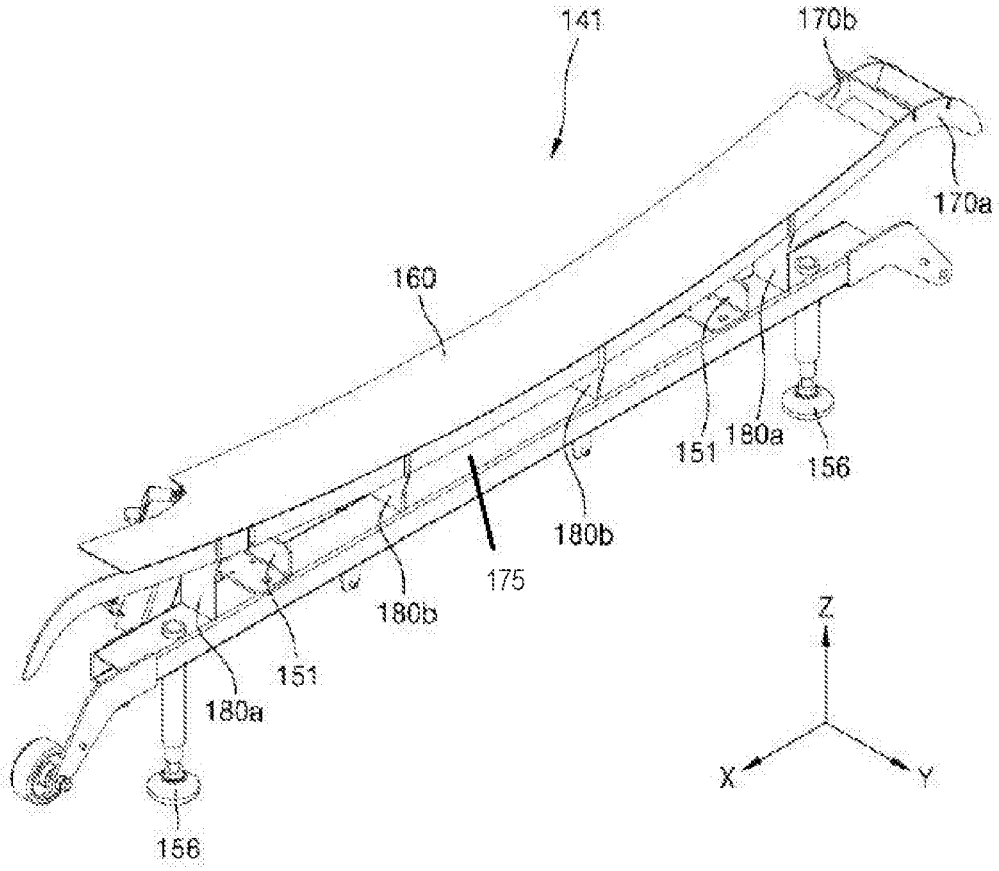
FIG. 5A is a perspective view of a first side frame according to an embodiment of the present disclosure.
Figure 5B:
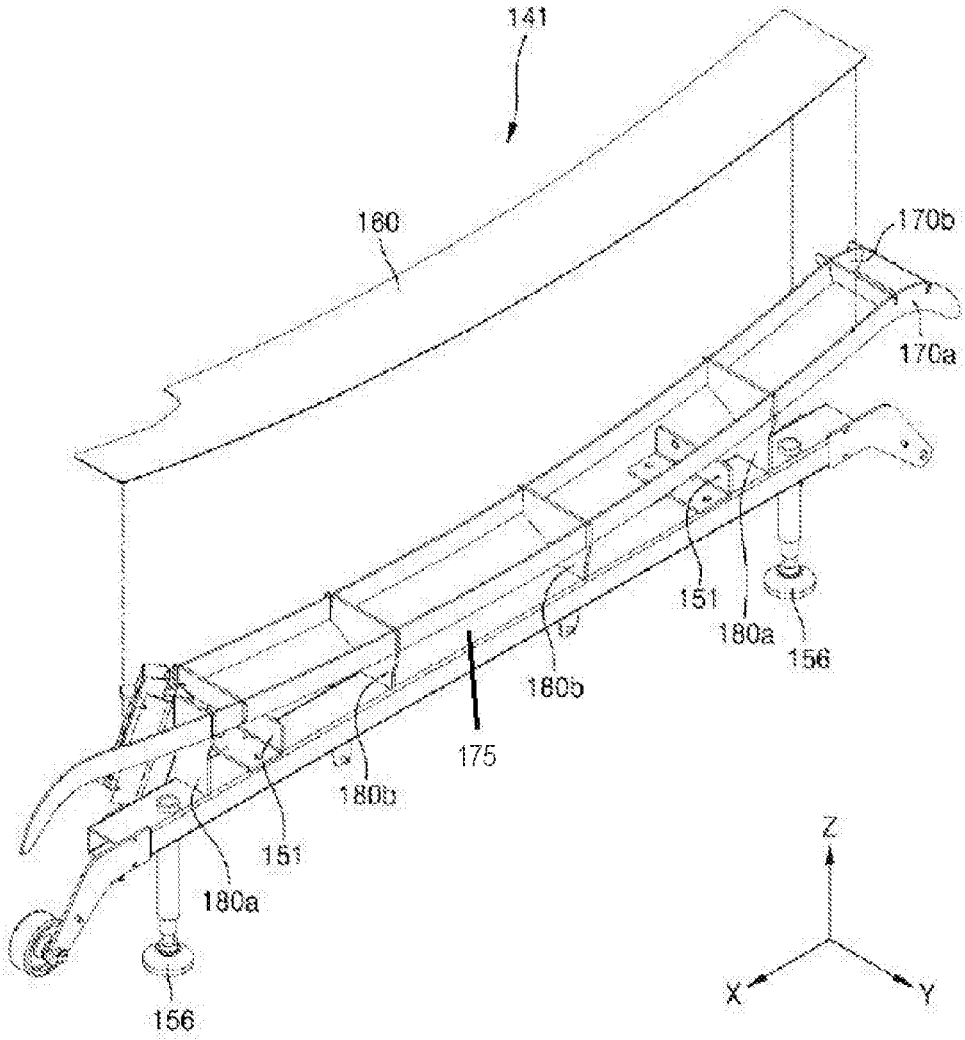
FIG. 5B is an exploded perspective view of a first side frame according to an embodiment of the present disclosure.
Figure 6A:
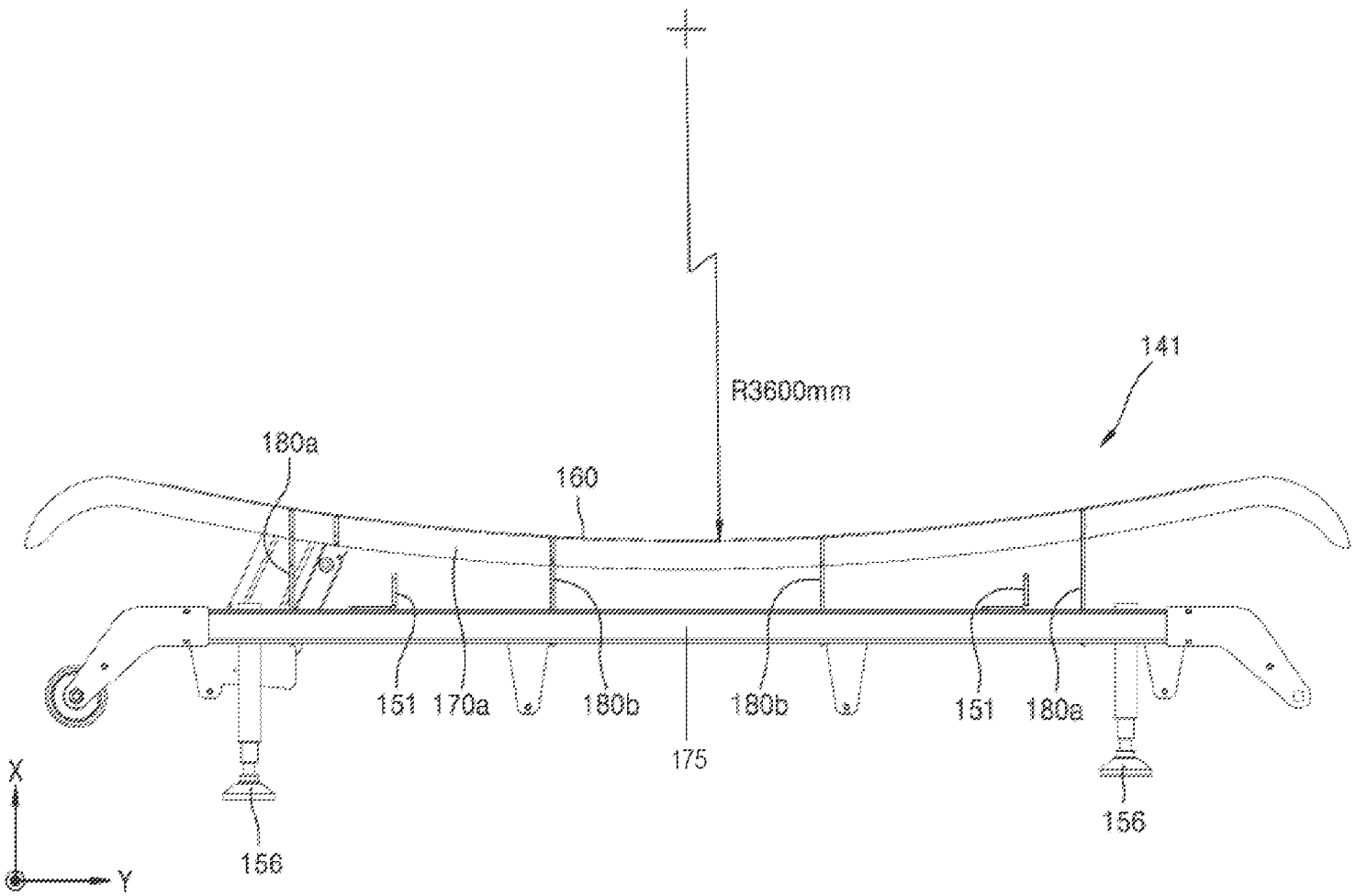
FIGS. 6A and 6B are side views of a first side frame according to an embodiment of the present disclosure.
Figure 6B:
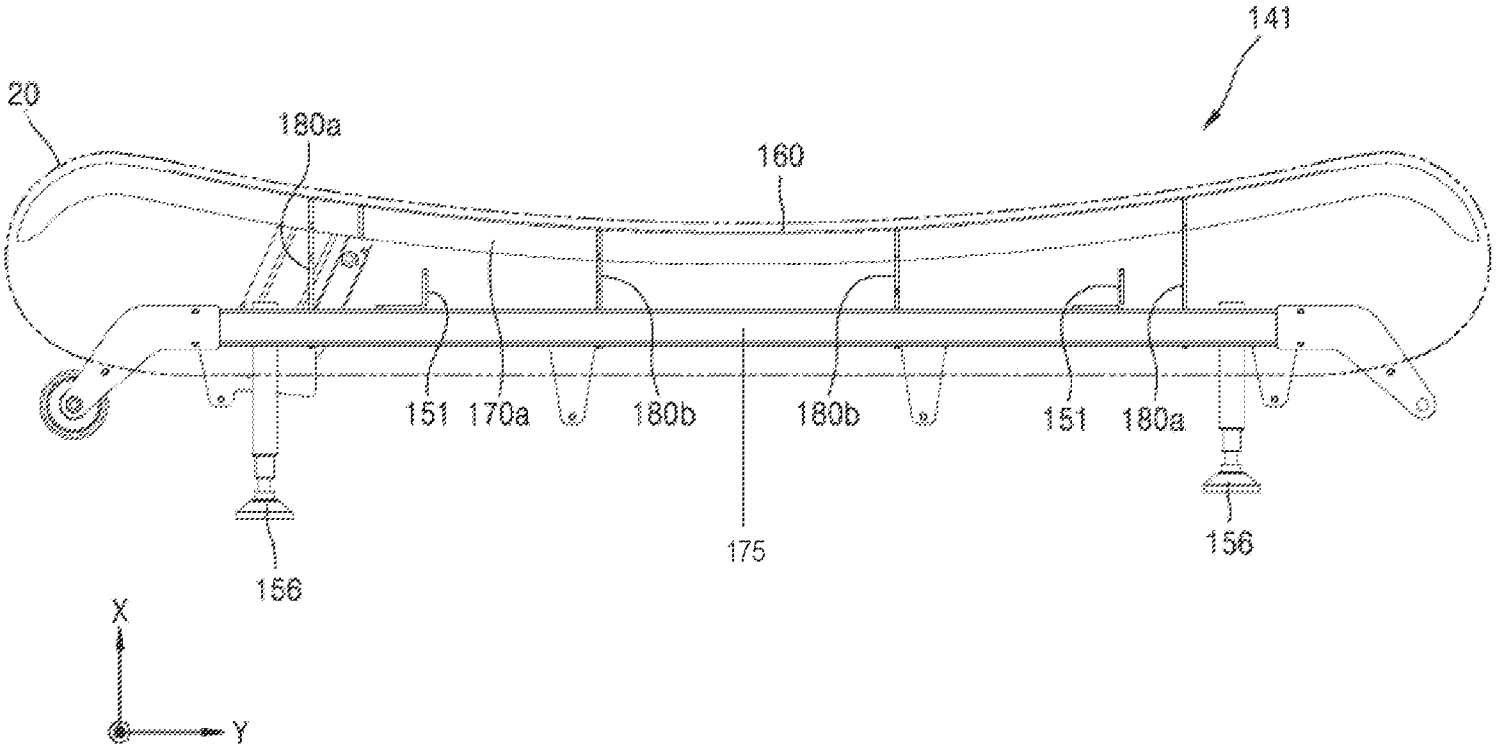

FIG. 5A is a perspective view of the first side frame 141 according to an embodiment of the present disclosure. FIG. 5B is an exploded perspective view of the first side frame 141 according to an embodiment of the present disclosure. FIGS. 6A and 6B are side views of the first side frame 141 according to an embodiment of the present disclosure.

Referring to FIGS. 5A and 5B, the first vertical supports 170*a* and 170*b* may extend in the second direction (i.e., the Y-axis direction) and have a top portion having a curved shape corresponding to the curved shape of the top portion of each of the first and second frames 110 and 120 of the central frame 100. For example, the radius of curvature of the top portion of the first vertical supports 170*a* and 170*b* may be equal to that of the top portion of the first and second frames 110 and 120 of the central frame 100. Here, when the radii of curvature are equal to each other, an error range may be within 5% of the radius of curvature that is greater than the other.

In addition, the first vertical supports 170*a* and 170*b* may be separated from each other in the first direction (i.e., X-axis direction).

The second vertical supports 180*a* and 180*b* may support the first vertical supports 170*a* and 170*b* and may be separated from each other in the second direction (i.e., the Y-axis direction). At least three second vertical supports 180*a* and 180*b* may be provided.

A groove into which each of the first vertical supports 170*a* and 170*b* may be inserted may be formed in each of the second vertical supports 180*a* and 180*b*. The side plate 160 may be positioned on the top portions of the first vertical supports 170*a* and 170*b* and may have a curved shape corresponding to the curved shape of the top portion of the first vertical supports 170*a* and 170*b*. The side plate 160 may be fixed to the first vertical supports 170*a* and 170*b* using welding.

Accordingly, the top portions of the first and second frames 110 and 120, the top portions of the first vertical supports 170*a* and 170*b*, and the side plate 160 may respectively have curved shapes corresponding to one another.

The curved shape of each of the first and second frames 110 and 120, which are curved corresponding to the curved shape of the top portion of the first vertical supports 170*a* and 170*b*, may correspond to the curved shape of a top portion of either the first or second side cover 20 or 30 (see FIG. 2).

The positioning members 151 and 152 may have a shape that enables each of the first and second horizontal bars 131 and 132 to move in the first direction (i.e., the X-axis direction) and limits movement of each of the first and second horizontal bars 131 and 132 in the second direction (i.e., the Y-axis direction). For example, the positioning members 151 and 152 may have an L-shape.

Each of the first and second horizontal bars 131 and 132 may include a fixing portion 155*a*, and each of the positioning members 151 and 152 may include a fixing portion 155*b*. Each of the first and second horizontal bars 131 and 132 may be fixed to the positioning members 151 and 152 by connecting fixing members (not shown) to the fixing portions 155*a* and 155*b*.

The legs 156 may transfer a load on the treadmill 1 to outside the treadmill 1.

FIGS. 6A and 6B are side views of the first side frame 141 according to an embodiment of the present disclosure.

Referring to FIGS. 6A and 6B, the side plate 160 may be fixed to the first vertical support 170*a* using welding.

The second vertical supports 180*a* and 180*b* may have different heights from each other. At least three second vertical supports 180*a* and 180*b* may be provided to support the side plate 160 and the first vertical support 170*a*. The height of the second vertical support 180*a* on either side in the the second direction (i.e., the Y-axis direction) may be greater than that of the second vertical support 180*b* in the middle in the the second direction (i.e., the Y-axis direction).

The first and second side covers 20 and 30 respectively covering the first and second side frames 141 and 142 may be respectively provided on outsides of the first and second side frames 141 and 142. The top portion of each of the first and second side covers 20 and 30 has a shape corresponding to the curved shape of the side plate 160, and accordingly, the top portion of each of the first and second side covers 20 and 30 may be in close contact with the side plate 160. A maximum distance between the side plate 160 of each of the first and second side frames 141 and 142 and either the first or second side cover 20 or 30 may be 0.5 cm or less.

Figure 7A:
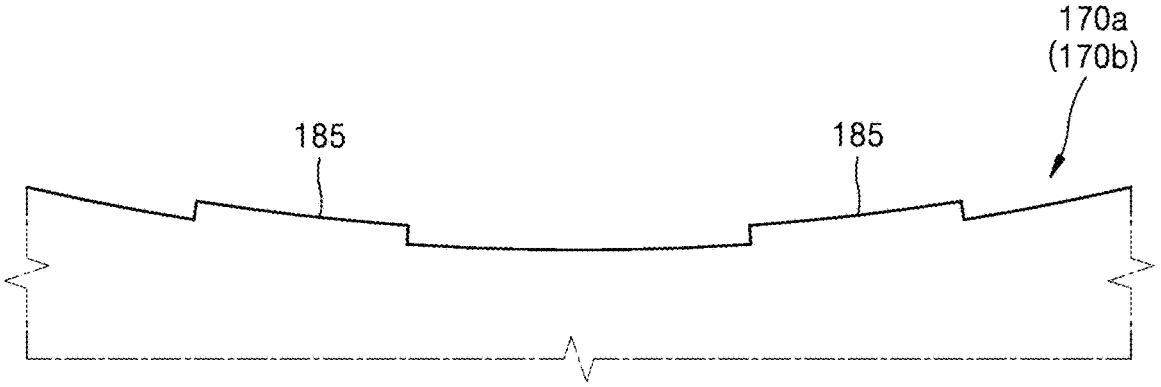
FIG. 7A is a side view of an example of a first vertical support.
Figure 7B:
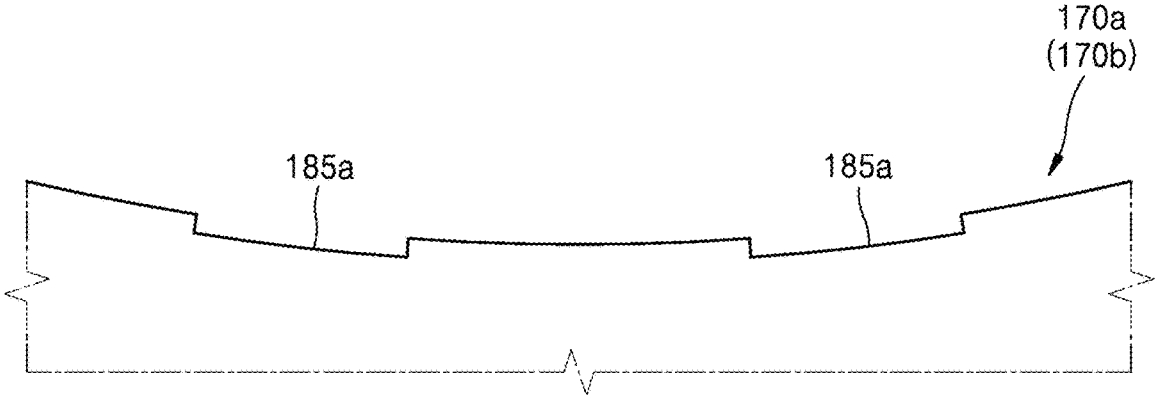
FIGS. 7B and 7C are side views of other examples of the first vertical support.
Figure 7C:
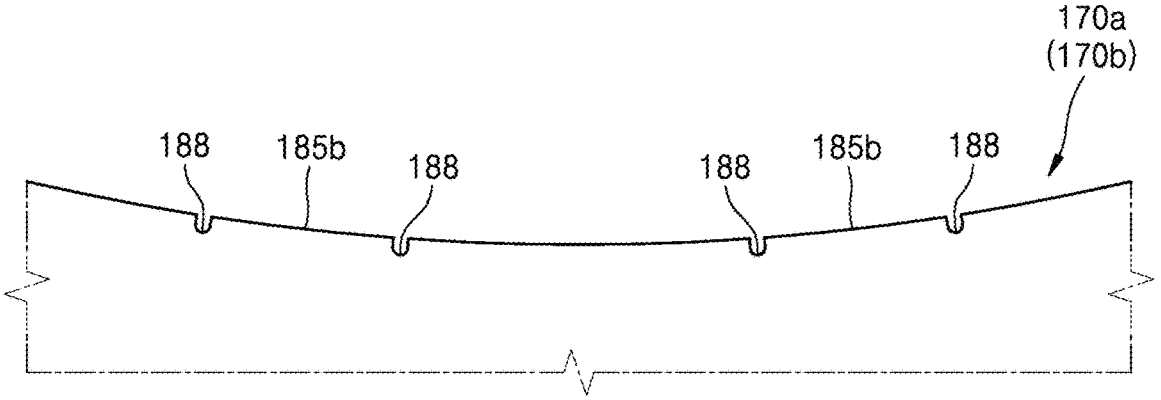

FIG. 7A is a side view of an example of each of the first vertical supports 170*a* and 170*b*, and FIGS. 7B and 7C are side views of other examples of each of the first vertical supports 170*a* and 170*b*. Referring to FIG. 7A, a plurality of welding position guide portions 185 may be formed at certain positions of each of the first vertical supports 170*a* and 170*b*. The welding position guide portions 185 mark positions at which welding is performed in the first vertical supports 170*a* and 170*b*, thereby guiding a worker to welding positions. The welding position guide portions 185 may have a protruding shape.

However, the function and the shape of the welding position guide portions 185 are not limited thereto and may be various. In an example, a welding position guide portion 185*a* may have a recessed shape, as shown in FIG. 7B, as a guide to a welding position. In another example, a welding position guide portion 185*b* may not protrude or be recessed from a top surface of the first vertical support 170*a* but may be defined by notches 188 respectively formed at both ends thereof.

As described above, a welder may be guided to exact welding positions through a plurality of welding position guide portions 185, 185*a*, or 185*b*. Accordingly, welding may be performed at exact positions between the first vertical support 170*a* and the side plate 160.

Figure 8A:
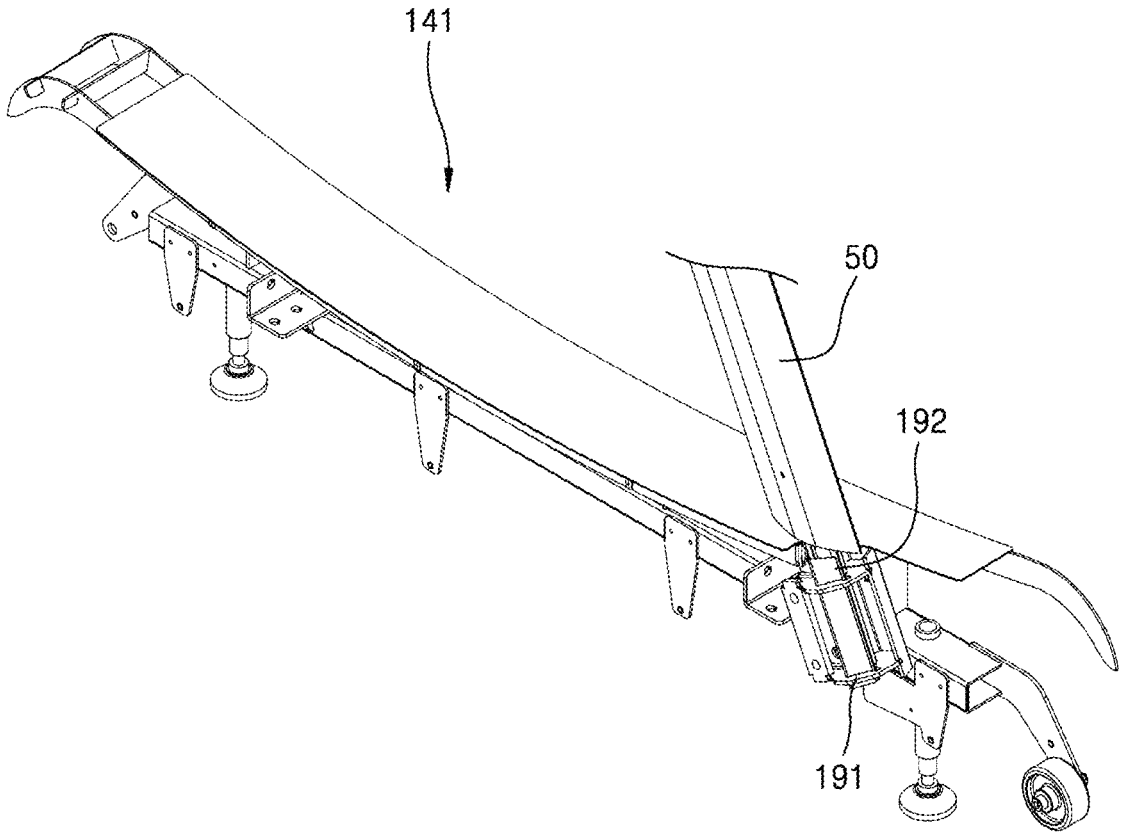
FIG. 8A is a perspective view of a first side frame according to an embodiment of the present disclosure.
Figure 8B:
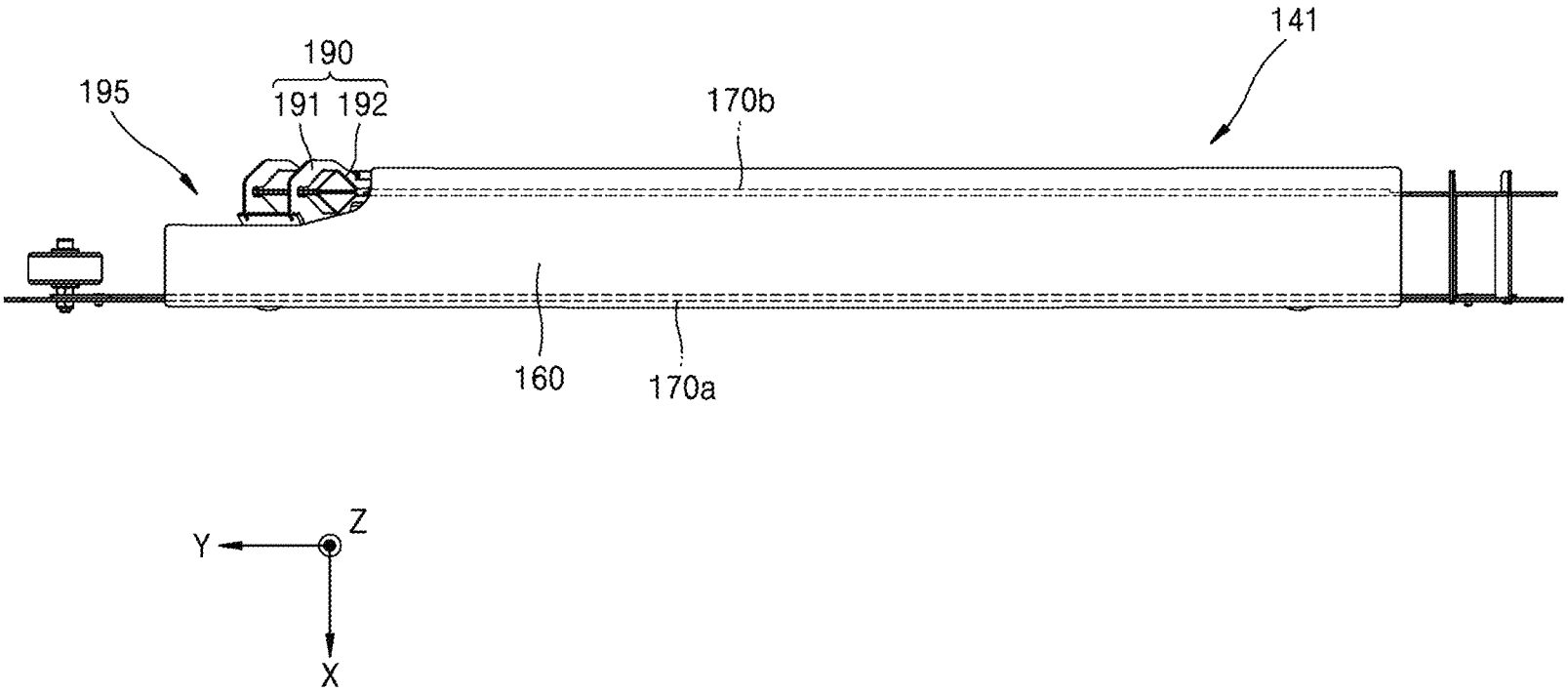
FIG. 8B is a plan view of a first side frame according to an embodiment of the present disclosure.
Figure 9A:
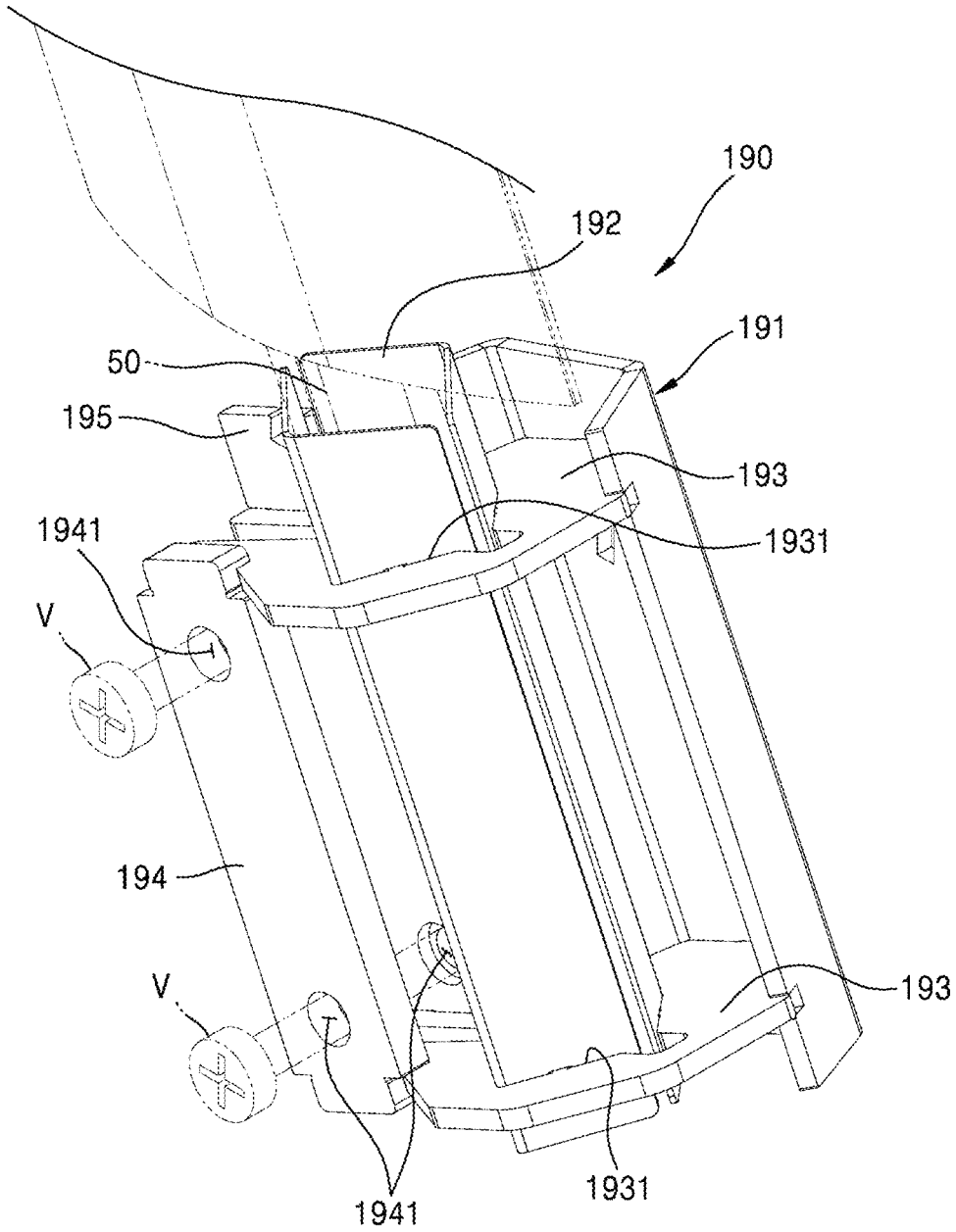
FIGS. 9A and 9B are respectively an assembled perspective view and an exploded perspective view of a fixing unit in FIG. 8A.
Figure 9B:
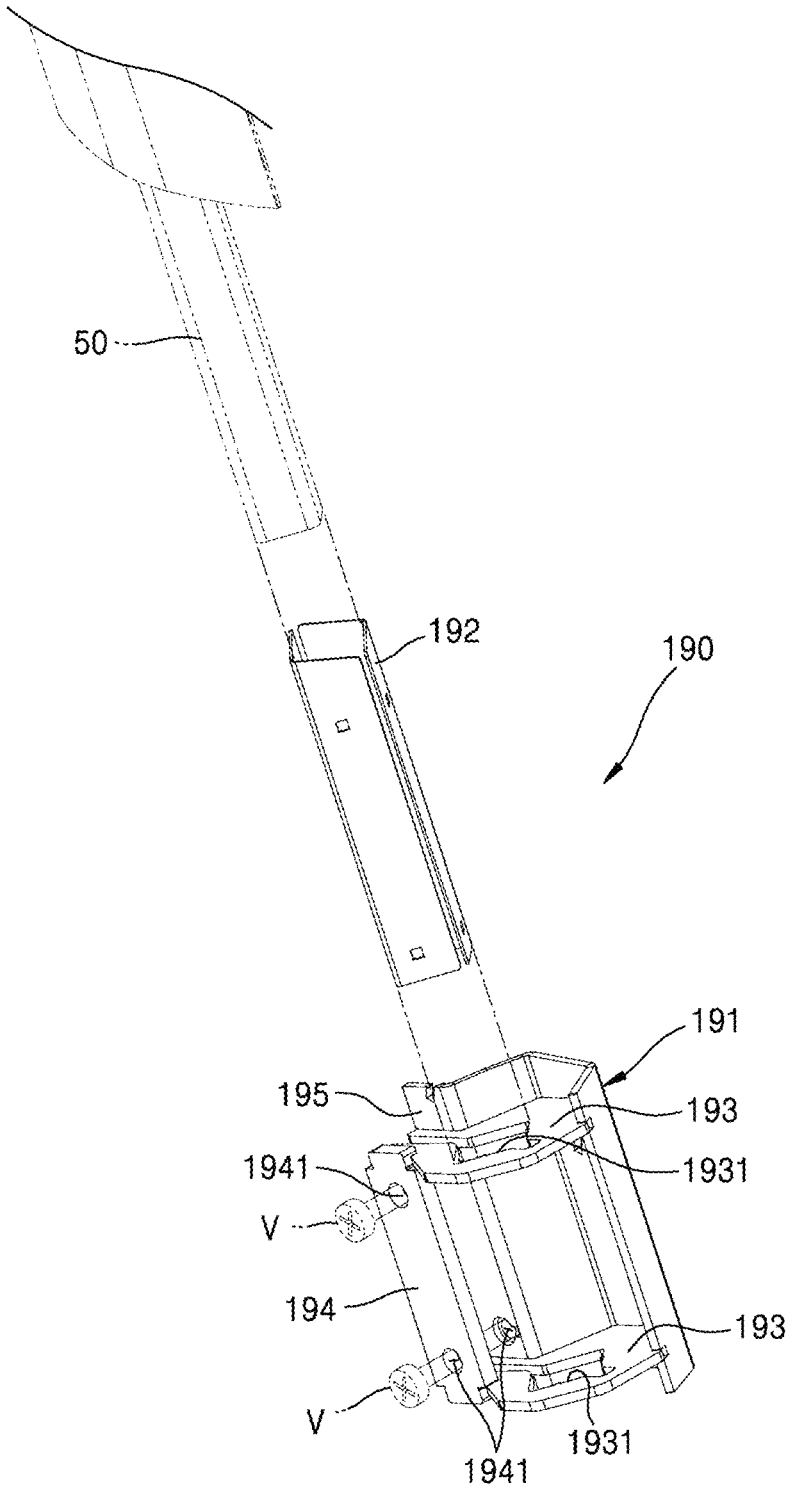

FIG. 8A is a perspective view of the first side frame 141 according to an embodiment of the present disclosure. FIG. 8B is a plan view of the first side frame 141 according to an embodiment of the present disclosure. FIGS. 9A and 9B are respectively an assembled perspective view and an exploded perspective view of a fixing unit 190 in FIG. 8A.

Referring to FIGS. 8A and 8B, the first side frame 141 includes the fixing unit 190. The fixing unit 190 fixes the handle supporting column 50 and may be configured to pressurize a circumference of the handle supporting column 50. The fixing unit 190 includes a guiding support 192 which guides the handle supporting column 50 into a pressurizing portion 191.

The pressurizing portion 191 may be provided surrounding the guiding support 192. The pressurizing portion 191 may apply pressure to the handle supporting column 50 via the guiding support 192.

The pressurizing portion 191 includes a plurality of pressing plates 193 having a plane crossing a length direction of the handle supporting column 50. Each of the pressing plates 193 has a pressing hole 1931 through which the guiding support 192 may pass. The handle supporting column 50 passes through at least a portion of the pressing hole 1931. The pressurizing portion 191 may further include connecting bars 194 and 195 connecting the pressing plates 193 to each other. Each of the connecting bars 194 and 195 has a coupling hole 1941 into which a coupling member V may be inserted.

The guiding support 192 may have various shapes, such as a diamond shape and a circular shape, and may be partially cut. The overall shape of the guiding support 192 may correspond to the shape of the handle supporting column 50.

The handle supporting column 50 may be inserted into the guiding support 192. After the handle supporting column 50 is inserted into the guiding support 192, the coupling member V is inserted into the coupling hole 1941 and screwed to control the connecting bars 194 and 195 to approach each other. In this process, the guiding support 192 inserted into the pressing hole 1931 of the pressing plates 193 is pressurized. Since the guiding support 192 is partially cut, an inner cross-section area of the guiding support 192 is reduced by the pressurization, and the guiding support 192 pressurizes the circumference of the handle supporting column 50. Accordingly, the handle supporting column 50 may be fixed to the fixing unit 190.

A cut portion 195 is formed in the side plate 160. The cut portion 195 is a region in which the fixing unit 190 and the handle supporting column 50 are positioned. The cut portion 195 is provided to prevent interference between the side plate 160 and the handle supporting column 50.

Since the cut portion 195 is formed in the side plate 160, the first vertical support 170*a* on the inside of the first side frame 141 and the first vertical support 170*b* on the outside of the first side frame 141 may have different lengths, respectively, in the second direction (i.e., the Y-axis direction). In other words, the length of the first vertical support 170*a* on the inside of the first side frame 141 may be greater than that of the first vertical support 170*b* on the outside of the first side frame 141 in the second direction.

According to the embodiments of the present disclosure, the treadmill 1 includes the first and second side frames 141 and 142 having a shape corresponding to the top curved shape of the central frame 100 and the first and second side covers 20 and 30 respectively having top curved shapes corresponding to the first and second side frames 141 and 142, so that the durability of the first and second side covers 20 and 30 may be maintained even if a user steps on the first and second side covers 20 and 30.

The embodiments described above are exemplary, and it will be understood by one of ordinary skill in the art to which the present disclosure belongs that the embodiments may be easily modified into other specific forms without changing the technical ideas or essential characteristics of the present disclosure. Accordingly, the embodiments described above should be considered as examples and not for purposes of limitation. For example, an element described as a single form may be implemented in a distributed fashion, and elements described as being distributed may be implemented in a combined form.

The scope of the embodiments is defined not by the detailed description above but by the appended claims. All changes or modifications drawn from the spirit and scope of the claims and their equivalent concept will be construed as being included in the scope of the embodiments.

What is claimed is:

1. A treadmill comprising:

a plurality of slats extending in a first direction and arranged in a second direction perpendicular to the first direction; and a frame structure configured to support both ends of each of the plurality of slats and further configured to allow the plurality of slats to move in the second direction, wherein the frame structure comprises:

a central frame including a top portion having a curved shape; and a first side frame and a second side frame respectively arranged on both sides of the central frame, wherein a top portion of each of the first and second side frames has a shape corresponding to the curved shape of the top portion of the central frame, and wherein each of the first and second side frames comprises:

a plurality of legs configured to support the treadmill;

a lower support placed over and supported by the plurality of legs;

a plurality of first supports placed over the lower support and extending in the second direction and separated from each other in the first direction, each of the plurality of first supports including a top portion having a curved shape corresponding to the curved shape of the central frame;

a plurality of second supports arranged in the second direction, the plurality of second supports disposed between the plurality of first supports and the lower support such that the plurality of first supports are vertically separate from the lower support by the plurality of second supports; and a side plate arranged on the top portion of the plurality of first supports and curved corresponding to the curved shape of the plurality of first supports.

2. The treadmill of claim 1, further comprising a handle supporting column fixed to the frame structure, wherein each of the first and second side frames comprises a fixing unit configured to fix the handle supporting column.

3. The treadmill of claim 2, wherein the fixing unit of at least one of the first and second side frames comprises a pressurizing portion configured to fix the handle supporting column by pressurizing a circumference of the handle supporting column.

4. The treadmill of claim 3, wherein the pressurizing portion of the fixing unit of the at least one of the first and second side frames comprises:

a plurality of pressing plates including a pressing hole through which the handle supporting column passes; and a connecting bar configured to connect the plurality of pressing plates to each other and having a coupling hole.

5. The treadmill of claim 4, wherein the fixing unit of the at least one of the first and second side frames further comprises a guiding support arranged passing through the pressing hole and corresponding to a shape of the handle supporting column.

6. The treadmill of claim 3, wherein the side plate of at least one of the first and second side frames has a cut portion configured to prevent interference between the respective handle supporting column and the respective side plate.

7. The treadmill of claim 6, wherein the plurality of first supports of at least one of the first and second side frames have different lengths from each other in the second direction.

8. The treadmill of claim 1, further comprising a first side cover and a second side cover respectively covering the first side frame and the second side frame.

9. The treadmill of claim 8, wherein a top portion of each of the first and second side covers has a shape corresponding to the curved shape of the side plate of the first and second side frames.

10. The treadmill of claim 9, wherein a maximum distance between the side plate of each of the first and second side frames and the respective first and second side covers does not exceed 0.5 cm.

11. The treadmill of claim 1, wherein the side plate of at least one of the first and second side frames is fixed to the plurality of first supports of the respective at least one of first and second side frames using welding.

12. The treadmill of claim 11, wherein the plurality of first supports of the at least one of the first and second side frames comprise a plurality of welding position guide portions.

13. The treadmill of claim 1, wherein the plurality of second supports of at least one of the first and second side frames have different heights from each other.

14. The treadmill of claim 13, wherein a number of the plurality of second supports of at least one of the first and second side frames is at least 3, and a height of a second support on either side in the second direction is greater than a height of a second support in a middle in the second direction.

15. The treadmill of claim 1, wherein the plurality of legs and the plurality of second supports of each of the first and second side frames are disposed on opposite sides of the respective lower support.

16. The treadmill of claim 15, wherein the plurality of legs and the plurality of second supports of each of the first and second side frames extend in opposite directions from the opposite sides of the respective lower support.

17. The treadmill of claim 1, wherein the plurality of slats are moved by a user's leg motion.

18. The treadmill of claim 1, wherein at least two of the plurality of second supports of each of the first and second side frames have different heights.

19. The treadmill of claim 1, wherein the plurality of legs and the plurality of second supports of each of the first and second side frames do not vertically overlap each other.

* * * * *